US005515960A

United States Patent [19]

Wood

[11] Patent Number: 5,515,960

[45] Date of Patent: May 14, 1996

[54] COIN SENSING APPARATUS

[75] Inventor: Dennis Wood, Oldham, England

[73] Assignee: Coin Controls Ltd., Oldham, England

[21] Appl. No.: 464,699

[22] PCT Filed: Dec. 17, 1993

[86] PCT No.: PCT/GB93/02582

§ 371 Date: Jul. 14, 1995

§ 102(e) Date: Jul. 14, 1995

[87] PCT Pub. No.: WO94/15322

PCT Pub. Date: Jul. 7, 1994

[30] Foreign Application Priority Data

Dec. 18, 1992 [GB] United Kingdom ..... 9226383

[51] Int. Cl.[6] ..... G07D 5/02

[52] U.S. Cl. ..... 194/328; 194/344

[58] Field of Search ..... 194/202, 203, 194/207, 328, 329, 330, 331, 334, 344

[56] References Cited

U.S. PATENT DOCUMENTS

| | | | |
|---|---|---|---|
| 3,978,962 | 9/1976 | Gregory, Jr. . | |
| 4,277,774 | 7/1981 | Fujii et al. | 194/207 X |
| 4,298,116 | 11/1981 | Niemeyer | 194/203 |
| 4,333,557 | 6/1982 | Kozak | 194/328 X |
| 5,236,074 | 8/1993 | Gotaas | 194/331 |
| 5,383,546 | 1/1995 | Mulder | 194/203 |

FOREIGN PATENT DOCUMENTS

| | | | |
|---|---|---|---|
| 0017428 | 10/1980 | European Pat. Off. . | |
| 0392110 | 10/1990 | European Pat. Off. . | |
| 2259982 | 10/1990 | Japan | 194/328 |
| 2144252 | 2/1985 | United Kingdom . | |
| 2227347 | 7/1990 | United Kingdom | 194/328 |
| 2250622 | 6/1992 | United Kingdom . | |

*Primary Examiner*—David A. Bucci
*Assistant Examiner*—Scott L. Lowe
*Attorney, Agent, or Firm*—Morgan & Finnegan

[57] ABSTRACT

A coin sensor, such as a post acceptance sensor for a coin validator, at a coin sensing station on a coin path having a sidewall, includes optical source and detector pairs that detect the presence of the coin by reflection of source radiation to the detector by the coin's surface. In order to improve sensitivity the side wall has an angled surface configuration which inhibits reflection of radiation from each source to the detectors in the absence of a coin.

8 Claims, 2 Drawing Sheets

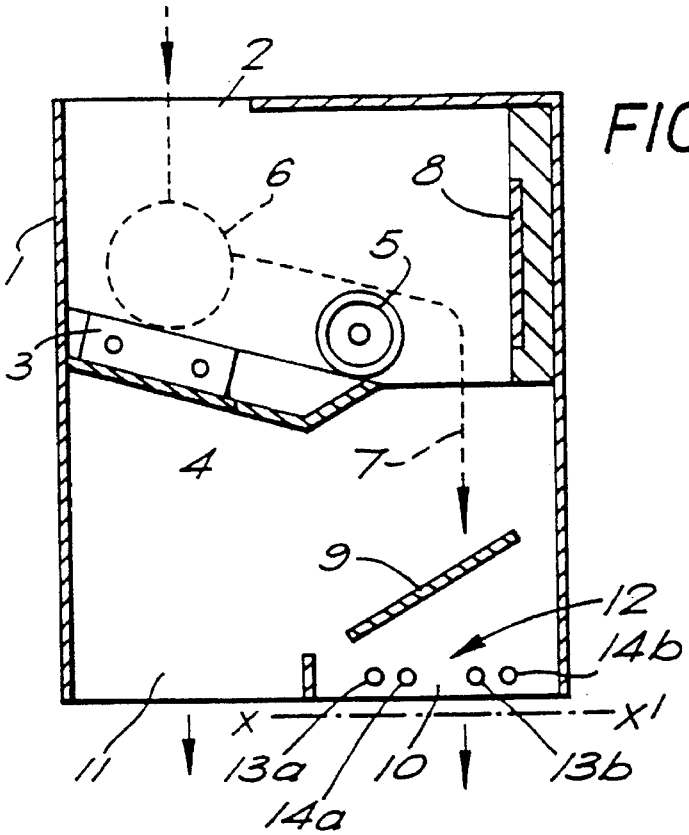
FIG.1.
FIG.4.
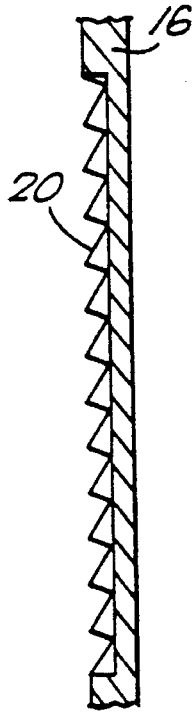
FIG.5.
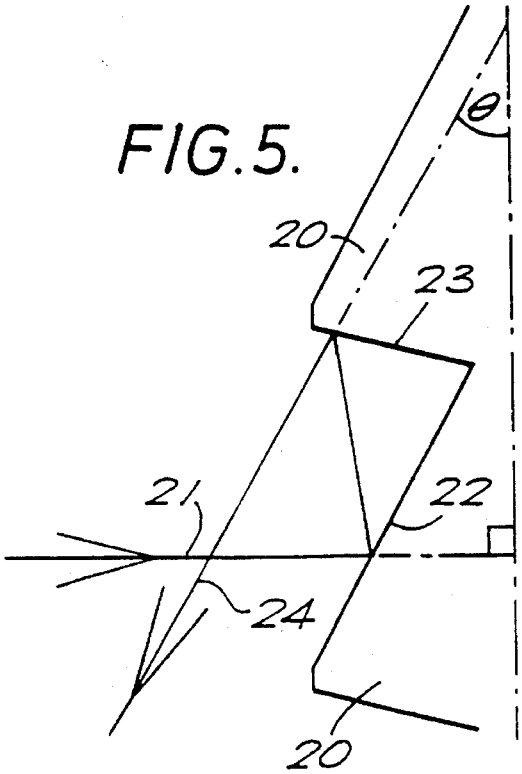
FIG.6.
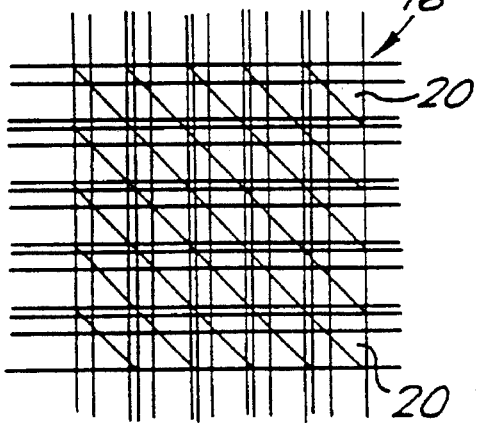

COIN SENSING APPARATUS

FIELD OF THE INVENTION

This invention relates to coin sensing apparatus that has particular but not exclusive application to a post-acceptance coin sensor, for sensing that an acceptable coin is passing along a predetermined path, subsequent to validation thereof by a coin validator.

BACKGROUND

In a conventional multi-coin validator, coins pass along a path past at least one sensor coil energised to produce an inductive coupling with the coin. The degree of interaction between the coil and the coin can be used to discriminate between different coin denominations and fraudulent coins. An example of such a validator is described in our co-pending application PCT/GB92/00791.

After passing the inductive sensor(s) the coin passes towards a solenoid operated accept gate. If, as a result of the inductive test, the coin is determined to be of acceptable denomination, the accept gate is opened and the coin passes along an accept path. Alternatively, if the coin is determined to have non-acceptable characteristics, the gate remains closed and the coin is diverted to a reject path. Operation of the gate is controlled by a microprocessor in dependence upon the output of the sensor(s). In order positively to confirm that an acceptable coin has passed the accept gate into the accept path, a sensor is included in the accept path, which provides an output to the microprocessor so that, for example, the microprocessor can monitor the credit accumulated through the accept path.

This post-acceptance sensor in the accept path has hitherto been constituted by a further inductive sensor but recently, proposals have been made to use optical sensing arrangements in the accept path. It has previously been proposed to use a pair of infra-red sources each with an associated phototransistor mounted in a common wall of the accept path. When a coin passes along the accept path, its side surface reflects infra-red radiation from at least one of the sources to the detector(s) in order to enable the coin to be detected. Source-detector pairs are used in order to provide sensitivity over the entire width of the accept path which may be significantly wider than the diameter of the coin. However, on occasions, the optical sensing arrangement may not detect an acceptable coin, particularly small coins, due mainly to the angle at which the coins fall as they pass the sensors or the dullness of the coin's surface. Whilst it would be possible to increase the sensitivity of the system by increasing the power of the emitted infra-red radiation, a problem arises in that with increased power, significant levels of radiation are reflected from the opposite side wall of the accept path, towards the detectors, which degrades their performance, since the difference between the levels of radiation received by the detectors in the presence and absence of a coin is reduced by the increased level of reflection from the opposite side wall.

SUMMARY OF THE INVENTION

The present invention provides a solution to this problem which has particular, but not exclusive application to post-acceptance sensors.

In accordance with the present invention, there is provided coin sensing apparatus including a coin sensing station; a path for coins, extending through the station, the path including a side wall; an optical source for directing radiation across the path towards the side wall; and an optical detector for detecting optical radiation returned thereto from the source by a coin when present at the sensing station, the side wall including an angled surface configuration which inhibits light incident thereon from the source from being returned to the detector by the side wall in the absence of a coin at the sensing station.

Preferably, the surface configuration consists of a plurality of facets arranged in an array so as to direct light incident thereon from the source in a direction away from the detector.

BRIEF DESCRIPTION OF THE DRAWINGS

In order that the invention may be more fully understood an embodiment thereof will now be described by way of example, with reference to the accompanying drawings in which:

FIG. 1 is a schematic side elevational view of a coin validator including coin sensing apparatus according to the invention;

FIG. 4 is an enlarged sectional view of the surface configuration of a side wall of the accept path shown in FIG. 3;

FIG. 5 is a magnified view of the arrangement of FIG. 4, showing a typical light path; and FIG. 6 is a schematic plan view of the surface configuration shown in FIG. 4.

DESCRIPTION OF EMBODIMENT

Figure 2:
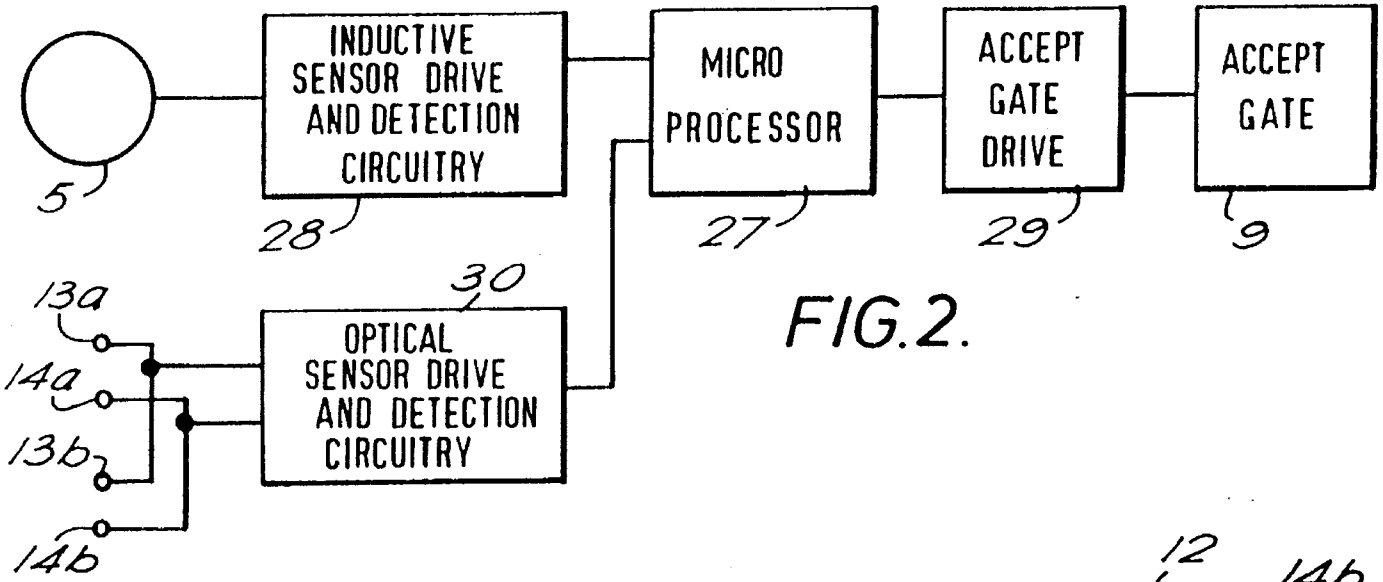
FIG. 2 is a block diagram of the electrical circuitry of the validator shown in FIG. 1.

Referring to FIG. 1, the validator consists of a body 1 including a coin inlet 2 into which coins are inserted from above, so as to fall onto an anvil 3 and then roll edgewise along a coin rundown 4 past an inductive sensing station 5. A coin 6 is shown in dotted outline, which travels along path 7, also shown in dotted outline.

Thus, the coin falls onto the anvil 3, then rolls edgewise along the path 4 until it strikes a snubber 8, turns through approximately 90° and falls towards a solenoid operated accept gate 9. Circuitry, to be described in more detail hereinafter, opens gate 9 to allow an acceptable coin to pass into an accept path 10, whereas for non-acceptable coins, the gate remains closed so that the coins pass to a reject chute 11.

The accept path 10 includes a post-acceptance sensing arrangement disposed at a sensing station 12. The arrangement includes two pairs of infra-red source and detectors 13, 14.

Figure 3:
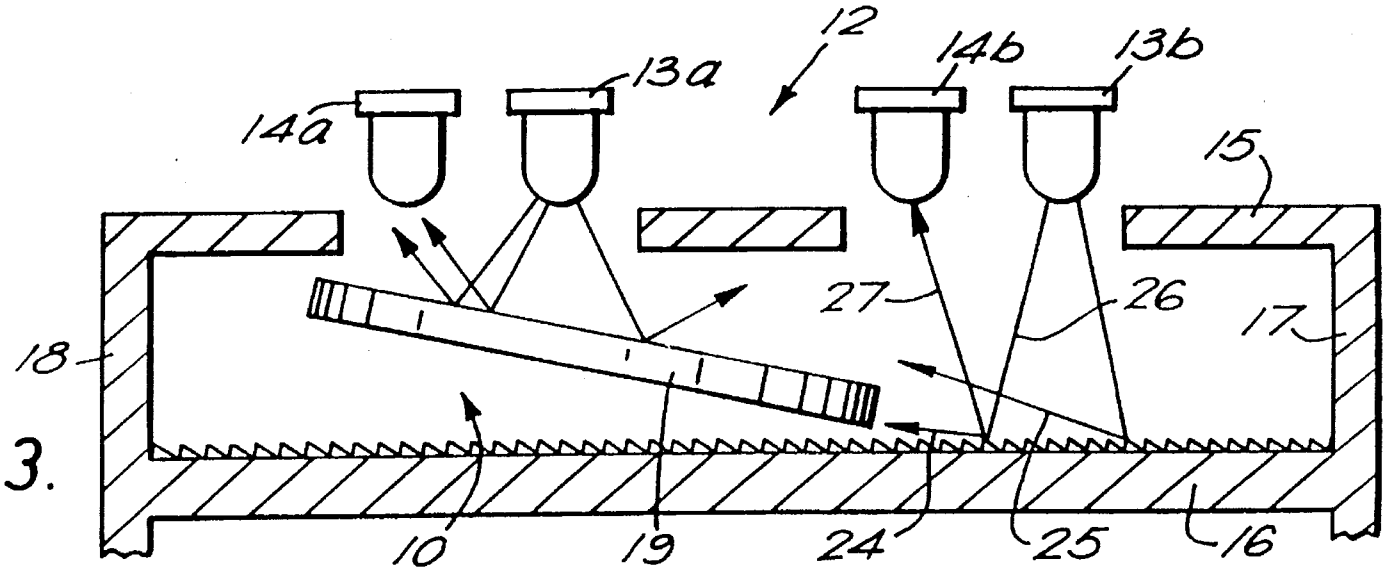
FIG. 3 is an enlarged sectional view of the coin acceptance path shown in FIG. 1.

FIG. 3 shows the accept path 10 in cross-section taken along the line X—X' of FIG. 1. The infra-red source and detector pairs 13*a*, 14*a*; 13*b*, 14*b* are spaced transversely across the width of the path 10. The path 10, which is oblong in cross-section includes an outer longitudinal wall 15, which includes spaced receptacles for the source and detectors 13, 14, the outer wall 15 being opposite a side wall 16. The path 10 also includes opposed end walls 17, 18. A coin 19 is shown schematically, falling down the path 10.

The side wall 16 is provided with a surface configuration to reduce the amount of light reflected from the sources 13*a*, *b* back towards the detectors 14*a*, *b*. As shown in section in FIG. 4, the surface of side wall 16 is provided with an array of triangular facets 20. As shown in FIG. 5, the facets 20 serve to direct light incident thereon in a non-uniform manner such that a major part of the incident intensity is directed transversely of the path 10, so as to be directed away from the detectors 14*a*, 14*b*. As shown by way of example in FIG. 5, a ray of light 21 incident normally upon the side wall 16 is directed by triangular surfaces 22, 23 in a direction 24 at a non-normal angle θ, so that the major portion of the energy is directed away from the detectors 14*a*, 14*b*. The multiple reflections also cause light additionally to be absorbed, also inhibiting light from returning to the reflectors.

Thus, in use, when a coin 19 passes through the sensing station 12, as shown in FIG. 2, infra-red radiation from source 13*a* is reflected by the shiny surface of the coin 19 to the detector 14*a* to provide an indication of the presence of a coin. Since in a multicoin validator, a plurality of different diameter coins may be accepted, the diameter of the coin may be significantly less than the width of the path 10 and for this reason, more than one emitter/detector pair 13, 14 may be required. Considering the second pair 13*b*, 14*b* shown in FIG. 2, light from the source 13*b* is incident upon the side wall 16 but due to the provision of the facets 20, the major part of the beam energy from source 13*b* is not directed back to the detector 14*b*; it is directed transversely away from the detector 14*b* as shown schematically by rays 24, 25. In contrast, if the facets 20 were not provided, light would be reflected by the side wall 16 generally such that the angle of incidence of a ray such as ray 26 on the surface would produce a corresponding equal angle of reflection to produce a ray such as ray 27, directed towards the detector 14*b*.

Thus, by provision of the facets 20, only a small proportion of the energy from sources 13*a*, 13*b* reaches the detectors 14*a*, 14*b* in the absence of a coin. As a result, the level of signal amplitude variation that occurs as a coin passes through the sensing station 12, is increased compared to a situation in which the facets 20 are omitted. This permits the sensitivity of the sensing station to be increased and the level of emission of the sources 13*a*, *b* can be increased without degrading the swing of signal amplitude that occurs at the detectors 14*a*, 14*b* as a coin passes through the station 12.

A number of different designs of facet 20 can be used to achieve the desired result. For example, as shown in FIG. 6, the facets may be triangular in plan view and arranged in a two dimensional array. Alternatively, they could be longitudinal ribs. In another configuration, an array of conical identations is provided in the surface of side wall 16, which act as traps for incident radiation from the source 13*a*, 13*b*. Other variations and modifications will be apparent to those skilled in the art.

Referring now to FIG. 2, the electrical circuitry associated with the validator includes a processor, for example a microprocessor 27 which is responsive to sensor circuitry 28 connected to the inductive sensor coil arrangement 5. This may constitute a phase locked loop arrangement as described in our Patent GB-A-2169429. In response to detection of an acceptable coin, the microprocessor 27 operates a driver circuit 29, which, in turn opens the accept gate 9. The outputs of the detectors 14*a*, *b* are connected through drive circuitry 30 to the microprocessor 27 so that when gate 9 has been opened to accept a coin, confirmation that the coin has entered the accept path 10 is provided by the detectors 14 to the microprocessor, to confirm that a credit has been accumulated.

I claim:

1. A coin handling apparatus including a coin sensing device, the coin sensing device including:

a coin sensing station;

a station path for coins, extending though the station, the station path including a side wall;

an optical source for directing radiation across the station path towards the side wall;

an optical detector for detecting optical radiation returned thereto from the source by a coin when present at the sensing station;

the side wall including an angled surface configuration which inhibits light incident thereon from the source from being return to the detector by the side wall in the absence of a coin at the sensing station.

2. Apparatus according to claim 1, wherein said angled surface configuration is arranged to direct light incident thereon from the source in a direction away from the detector.

3. Apparatus according to claim 1, wherein said surface configuration is operative to cause absorption of light from the source in the absence of a coin at the sensing station.

4. Apparatus according to claim 1 wherein said surface configuration includes a two dimensional array of facets on the side wall.

5. Apparatus according to claim 1 wherein said coin handling apparatus is a coin validator and said sensing station comprises a post-acceptance sensing station in said coin validator.

6. Apparatus according to claim 5 wherein said sensing station includes first and second optical source and detector pairs disposed across the width of the station path.

7. Apparatus according to claim 1 wherein said coin handling apparatus is a coin validator.

8. Apparatus according to claim 7 further including a coin rundown path, a coin validation sensor for coins as they pass along the rundown path, processor means responsive to the coin validation sensor for determining coin authenticity, an accept gate and drive means responsive to the processor for operating the accept gate.

* * * * *